US010784588B2

(12) United States Patent
Svensson

(10) Patent No.: US 10,784,588 B2
(45) Date of Patent: Sep. 22, 2020

(54) SURFACE MOUNTED BROADBAND ELEMENT

(71) Applicant: SAAB AB, Linköping (SE)

(72) Inventor: Bengt Svensson, Mölndal (SE)

(73) Assignee: SAAB AB, Linköping (SE)

( * ) Notice: Subject to any disclaimer, the term of this patent is extended or adjusted under 35 U.S.C. 154(b) by 278 days.

(21) Appl. No.: 15/537,306

(22) PCT Filed: Dec. 19, 2014

(86) PCT No.: PCT/SE2014/051554
§ 371 (c)(1),
(2) Date: Jun. 16, 2017

(87) PCT Pub. No.: WO2016/099367
PCT Pub. Date: Jun. 23, 2016

(65) Prior Publication Data

US 2017/0331199 A1 Nov. 16, 2017

(51) Int. Cl.
*H01Q 21/06* (2006.01)
*H01Q 13/08* (2006.01)
(Continued)

(52) U.S. Cl.
CPC ..... *H01Q 21/064* (2013.01); *H01Q 1/22* (2013.01); *H01Q 13/085* (2013.01);
(Continued)

(58) Field of Classification Search
CPC .. H01Q 21/064; H01Q 13/085; H01Q 13/106; H01Q 9/28; H01Q 21/22; H01Q 21/20; H01Q 13/10
See application file for complete search history.

(56) References Cited

U.S. PATENT DOCUMENTS 5,742,257 A 4/1998 Hadden et al.
6,967,624 B1 11/2005 Hsu et al.
(Continued)

OTHER PUBLICATIONS

International Search Report of PCT/SE2014/051554, dated Sep. 4, 2015.
(Continued)

*Primary Examiner* — Ricardo I Magallanes
(74) *Attorney, Agent, or Firm* — Venable LLP; Jeffri A. Kaminski

(57) ABSTRACT

The disclosed subject matter concerns an antenna which comprises a ground plane and at least a first and a second antenna element. Each antenna element comprises a feed point, a cavity, a main body, a tip and at least a first tapered portion and a second tapered portion. Each antenna element is arranged on the ground plane, where said first and second tapered portions extend along the antenna element from said tip towards the ground plane of the antenna element, and where each antenna element extends essentially perpendicularly to said ground plane along a centre axis of the antenna element. Each antenna element has at least a first leg and a second leg, where said first leg extends from said main body to the first feed point, where said feed point is located between the first leg and the ground plane, and where said second leg extends from said main body to the ground plane, and where said second leg is electrically connected to the ground plane.

18 Claims, 4 Drawing Sheets

(51) Int. Cl.

| | |
|---|---|
| ***H01Q 25/00*** | (2006.01) |
| ***H01Q 1/22*** | (2006.01) |
| ***H01Q 13/10*** | (2006.01) |
| ***H01Q 21/00*** | (2006.01) |

(52) U.S. Cl.
CPC ..... *H01Q 13/106* (2013.01); *H01Q 21/0006* (2013.01); *H01Q 25/001* (2013.01)

(56) References Cited

U.S. PATENT DOCUMENTS

2003/0214450 A1 11/2003 Lynch et al.
2004/0004580 A1* 1/2004 Toland ..... H01Q 13/025 343/893
2006/0038732 A1 2/2006 DeLuca et al.
2011/0057852 A1* 3/2011 Holland ..... H01Q 9/28 343/795
2013/0214980 A1* 8/2013 Lambert ..... H01Q 13/085 343/771

OTHER PUBLICATIONS

Written Opinion of PCT/SE2014/051554, dated Sep. 4, 2015.
Extended European Search Report issued in Corresponding European Application No. 14908531.8 dated Jun. 1, 2018 (9 pages).
Ka Ming Mak et al.; "Low Cost Dual Polarized Base Station Element for Long Term Evolution"; IEEE Transactions on Antennas and Propagation, vol. 62, No. 11, Nov. 2014, pp. 5861-5865 (5 pages).
A. Kedar et al.; "Wide Beam Tapered Slot Antenna for Wide Angle Scanning Phased Array Antenna"; Progress in Electromagnetics Research B, vol. 27, Jan. 2011, pp. 235-251 (17 pages).

* cited by examiner

SURFACE MOUNTED BROADBAND ELEMENT

CROSS-REFERENCES TO RELATED APPLICATIONS

This application is a U.S. National Stage application of PCT/SE2014/051554, filed 19 Dec. 2014 and published on 23 Jun. 2016 as WO 2016/099367 which is hereby incorporated by reference in its entirety.

TECHNICAL FIELD

The present invention relates to an antenna comprising at least a first and second antenna element and a ground plane. The antenna elements comprise tapered portions which taper to a feed point near the ground plane. The invention is suitable for use in e.g. radar systems or other instances where an improved antenna may be suitable.

BACKGROUND ART

Antennas are used to convert electric power to and from radio waves. They are vital for use in any situation where radio waves are essential for operation such as e.g. in applications in radio, radar, cell phones, wireless networking and RFID tags.

A common type of antenna element for broadband applications is a Vivaldi array antenna comprising a plurality of Vivaldi elements. Other tapered notch antenna designs may also be used. These Vivaldi elements are often made by etching a printed pattern on a dielectric substrate. The Vivaldi or tapered notch antennas typically have a radiating part starting with a slotline which widens in one direction in a tapered notch. The slotline is typically fed from a transmission line, coaxial line, microstrip or stripline, at the most narrow point, either by direct, electrical contact or by means of an essential quarter wave stub. Below the feed point, the slotline must constitute an open circuit in order to avoid short circuiting the feed. This can be accomplished either by another quarter wave slotline stub, which transforms a short circuit to an open end at the feed, or, which is more common for broadband applications, a cavity which is large enough to act as an open circuit at the feed point. They can be used in pairs arranged in essentially orthogonal directions to act as dual polarized antenna elements to transmit and receive signals with either linear polarizations or a combination of them. Further, they are often used in an array in order to e.g. achieve Multiple-In-Multiple-Out capability, transmitting and receiving on different amplitudes or using them in a phased antenna array with electrically scanned beams to supress undesired directions and enhance the desired ones in order to form a directed antenna.

Most modern applications will also require every single element to be connected to electronic circuits such as e.g. transmit/receive modules containing amplifiers and phase shifters.

Using Vivaldi or tapered notch elements does have some drawbacks which are especially apparent when mounting a large amount in an array. Printing them on a substrate is a rational process for a one dimensional array and the electronics may also be printed on the same substrate in a so called Brick configuration. However, the total length of the element and the electronic circuit board will be quite large. Also when combining perpendicular boards to dual polarized antenna arrays, the corners of the ground planes must be electrically connected, which is difficult to perform in a rational manufacturing process.

Using a so called Tile configuration, the electronics are mounted in one or several layers of a circuit board which is perpendicular to the antenna array surface. However, one difficulty is to feed the antenna elements, above the cavity, from a point on the circuit board surface. Typically this is accomplished by means of a coaxial line which will have to made very small in order not to make the cavity too small. It may also require very small parts and manual mounting and soldering. The connecting of the feed point is a task requiring precision and takes up a non-trivial part of the manufacturing process. Further, it may be difficult to achieve satisfactory fail rates of such antenna elements as the feed point may be very sensitive to faults.

US 2013/0214980 A1 describes a dual-polarized antenna array with a plurality of members which form tapered slots with nearby members to act as radio wave radiating structures. A slotline is used to connect the feed points of the antenna array with a tapering section. The antenna array also comprises a BALUN structure. Further, a method for constructing such an antenna is also provided in the disclosure.

While the existing solutions work well in some situations, there is still room for an improved antenna.

SUMMARY OF THE INVENTION

An object of the present invention is to provide an improved antenna allowing an improved assembly process and/or increased reliability of the antenna. Another object of the present invention is to provide an antenna array comprising an improved antenna. Another object of the present invention is to provide a radar system comprising an improved antenna.

One object of the invention is achieved by an antenna according to claim 1. This antenna comprises a ground plane and at least a first and a second antenna element, where each antenna element comprises a feed point, a cavity, a main body, a tip and at least a first tapered portion and a second tapered portion. Each antenna element is arranged on the ground plane, and said first and second tapered portions extend along the antenna element from said ground plane to the tip of the antenna element, and each antenna element extends perpendicularly to said ground plane along a centre axis of the antenna element. Each antenna element has a first leg and a second leg, where said first leg extends from said main body to the first feed point, where said feed point is located between the first leg and the ground plane, and where said second leg extends from said main body to the ground plane and where said second leg is electrically connected to the ground plane. The main body and said first and second legs of each antenna element have a predefined thickness. Said cavity of each antenna element is formed in a space between said first and second legs, said main body and said ground plane of said antenna element. The first and second antenna elements are arranged in a first plane extending through the centre axes of said first and second antenna elements and adjacent each other such that a tapered slot is formed between the first tapered portion of the first antenna element and the second tapered portion of the second antenna element, and where said tapered slot tapers to said feed point.

An antenna according to the invention improves the production process of said antenna, as the antenna elements are simpler, and the connection with the feed point is located at the bottom ground plane rather than inside the antenna element which would require a complicated transmission line and which could also diminish the cavity. The cavity of each element is formed within the element itself rather than between the feed point and the ground plane. This allows the elements that make up the antenna to be much more easily manufactured and assembled, as the important connections are located at the ground plane and may be readied before assembling the elements to the ground plane. Rather than the complex step of attaching a transmission line feed point at the end of the taper and the cavity of a Vivaldi or tapered notch element, the feed point is thus more simply connected at the bottom of the element. This allows the antenna, and by extension an antenna array using the same antennas, to be manufactured more easily in an automatic process saving time and effort. The improved manufacturing afforded by the invention is especially advantageous when using a tile-configuration for building the antenna or larger antenna structures. Additionally, the antenna allows the use of pick and place manufacturing which also constitutes an improvement in the manufacturing process. As the cavity is folded up into the element, the element can be made shorter than many previous antenna element/antenna designs.

In one development of the invention, the antenna comprises at least a further third and a fourth antenna element, said third and fourth antenna elements corresponding to the first and second antenna elements, where the third antenna element is arranged such that the centre axis of the first antenna element is aligned with the centre axis of the third antenna element, whereby the first antenna element and third antenna element form a dual-polarized antenna. The third and fourth antenna elements are arranged in a second plane perpendicular to the first plane and adjacent each other such that a tapered slot is formed between the first tapered portion of the third antenna element and the second tapered portion of the fourth antenna element.

By combining two antenna elements into a dual-polarised antenna element, the elements can be arranged to construct dual-polarised antennas incorporating the benefits of the improved antennas of the invention.

In one development of the invention, the third antenna element is integral with the first antenna element to form the dual-polarized antenna element.

In one development of the invention, the main body of said first antenna element and said third antenna element together forms a tapered cone, where the sum of the legs of the first antenna and the third antenna element is at least four. Preferably, at least two of these (one per antenna element) are of the type extending towards a feed point located between the leg and the ground plane, i.e. a first leg.

In one development of the invention, the antenna further comprises a circuit board, where one side of the circuit board constitutes the ground plane, and where the opposite side of the circuit board is equipped with at least one additional electrical component. The circuit board is equipped with a via hole at the at least first feed point. Said via hole runs through said circuit board, enabling an electrical connection of the feed point to an electrical component located on the opposite side of the ground plane.

In one development of the invention, the ground plane is equipped with a through-hole in which a connector is arranged, and where said feed point is connected to a centre conductor of said connector.

A number of suitable methods may be used for manufacturing the antenna elements. The element may be manufactured by punching or milling a metal plate to achieve the tapered portions. The legs may be created by e.g. milling or punching out the cavity of the element, making the two legs integral parts of the element. The element may also be constructed by casting. The antenna element may be manufactured from metal or a metallized plastic. The antenna element may be assembled to the ground plane using surface mount technology, or assembled onto a printed-circuit board (PCB). Laser or water cutting are also viable methods of production.

In one development of the invention, the tapered sections are formed in stepped sections rather than a continuous taper.

In one development of the invention, the cavity of the antenna elements is rectangular. In another development of the invention, the cavity has a different shape and may be rounded or polygonal.

Another object of the invention is achieved by an antenna array according to the disclosure. The antenna array comprises a plurality of antennas which consist of dual-polarized antenna elements according to the claims. An antenna array consisting of single polarized antennas is also feasible.

Another object of the invention is achieved by a radar system comprising an antenna or an antenna array according to the disclosure.

DETAILED DESCRIPTION

Various aspects of the invention will hereinafter be described in conjunction with the appended drawings to illustrate and not to limit the invention, wherein like designations denote like elements, and variations of the described aspects are not restricted to the specifically shown embodiment, but are applicable on other variations of the invention.

Figure 1:
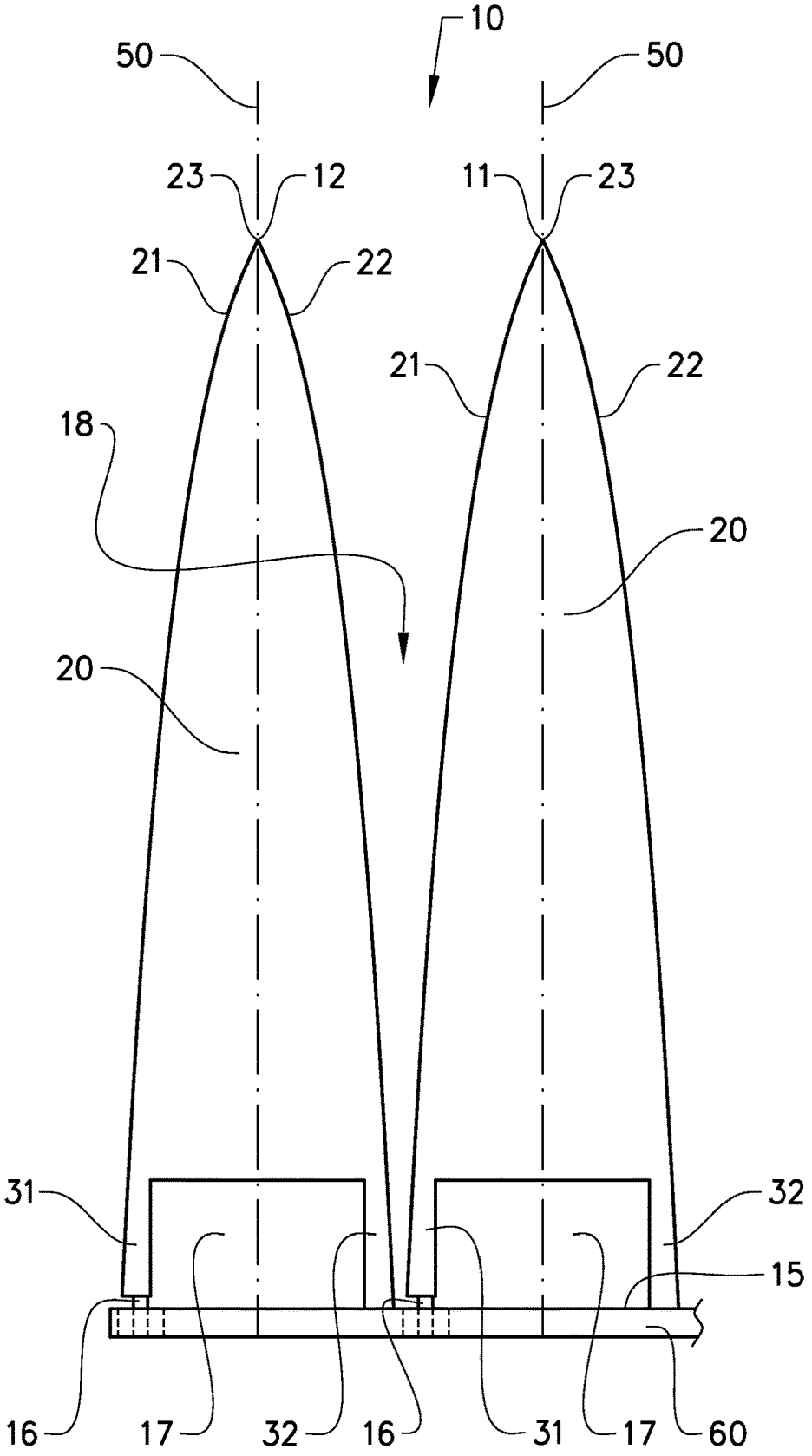
FIG. 1 shows a side view of an antenna comprising a first and second antenna element according to the invention.

FIG. 1 shows a side view of an antenna 10 according to the invention. The antenna comprises a first antenna element 11, and a second antenna element 12. The antenna further comprises a ground plane 15 on which the first and second antenna elements 11, 12 are arranged. Each antenna element has a centre axis 50 along which each respective antenna element extend perpendicular to said ground plane. Each of the first and second antenna elements 11, 12 comprise a tip 23 located at the end of the antenna element 11, 12 located farthest away from the ground plane 15. Each antenna element 11, 12 also comprise a main body 20 and a first tapered portion 21 and a second tapered portion 22. The antenna elements 11, 12 are substantially flat, with a predetermined thickness. The antenna elements are arranged in a first plane 51 extending through the centre axes 50 of each of the first and second antenna elements 11, 12. Each antenna element has a first leg 31 and a second leg 32. The legs 31, 32 are essentially integral with the main body of the antenna element. Each antenna element comprises a feed point 16 located between the ground plane and the first leg. The second leg is electrically connected to the ground plane. The first tapered portion extends from the tip of the antenna element along a side of the element to the end of the first leg at the feed point. The second tapered portion extends from the tip of the antenna element along a side of the element and along the second leg. In FIG. 1 the second tapered portion extends from the tip to the ground plane. Alternatively, the second tapered portion may end at a position on the second leg at the same distance from the ground plane as the distance between the first leg and the ground plane. In this case, the second leg is perpendicular for the remaining extension to the ground plane.

The first and second antenna elements 11, 12 are arranged adjacent to each other, such that a tapered slot 18 is formed between the first tapered portion 21 of the first antenna element 11 and the second tapered portion 22 of the second antenna element 12. Together, the first and second antenna elements 11, 12 thus form an antenna 10 capable of transmitting and/or receiving radio waves. Placing additional elements in series allows the forming of an antenna array 70 with a large number of antennas, where, in the same manner as the first and second elements, adjacent antenna elements form antennas. These antennas may then be arranged to transmit/receive on different amplitude and/or with different phase. While each antenna element has a feed point 16, the feed point of the antenna is in this case the feed point of the first antenna element 11. Should an additional antenna element be placed adjacent to the second antenna element 12 in the first plane on the opposite side from that of the first antenna element, the feed point of the second antenna element would be the feed point of the antenna formed by the tapered slot 18 between the additional antenna element and the second antenna element.

The feed point 16 is the electrical point which feeds the radio waves to the antenna 10 when transmitting or receiving the incoming radio waves incoming into the antenna. The antenna further comprises a circuit board 60 where one side of said circuit board constitutes the ground plane 15. The opposite side of the circuit board is equipped with electrical components 61. A via hole 62 runs through the circuit board providing an electrical connection between the feed point and an electrical component located on the opposite side of the circuit board. The immediate area surrounding the via hole is etched out such that there is no electrical contact between the ground plane and the via hole. The feed point is thus electrically connected to the components using the via hole in order to perform said transmitting or receiving of radio waves. It should be noted that a multi-layer circuit board could be used, and the via hole may be in connection with a layer.

Optionally, the ground plane 15 could be a solid metallic sheet with a connector arranged in a through-hole. The first leg 31 of the antenna element is then connected to this connector.

The antenna elements 11, 12, 13, 14 are produced using any of a multitude of suitable materials or methods. The elements can be metallic, metallized plastic or even plastic with metal strips arranged in suitable places. The method of production chosen may depend on the material used, but moulding, casting, milling or punching are examples of viable options. Laser or water cutting are also viable methods of production.

The details of the size of the antenna elements 11, 12, 13, 14 are subject to variations depending on the frequency band they are designed for. In general the width of the antenna elements (i.e. the extension in the first plane 51) is about $\lambda/2$, the length of the antenna elements (i.e. the extension along the centre line 50) varies from about $\lambda/2$ to several integer multiples of $\lambda$ depending on the bandwidth. The thickness of each antenna element varies by the required impedance, but the values are usually smaller than $\lambda/10$.

While the cavity 17 shown in FIG. 1 is of a rectangular shape, a plurality of shapes are possible for the cavity as long as the shape of the cavity confers electromagnetic wave properties of the antenna 10 which allow for operation of said antenna. The cavity may for instance be rounded in shape or polygonal. One special case is where the cavity is shaped as a stub line, wherein the cavity is a narrow slotline, preferably with the same width as the distance between the first leg 31 and the ground plane 15. The stub line or slotline cavity then extends for a length along the ground plane about a quarter lambda or $\lambda/4$. The stub line or slotline cavity can be bent in different shapes as long as the length is correct. The stub line or slotline cavity may advantageously be soldered or glued using conductive glue onto a circuit board. Using a stub line or slotline cavity decreases the bandwidth of the antenna.

Figure 2:
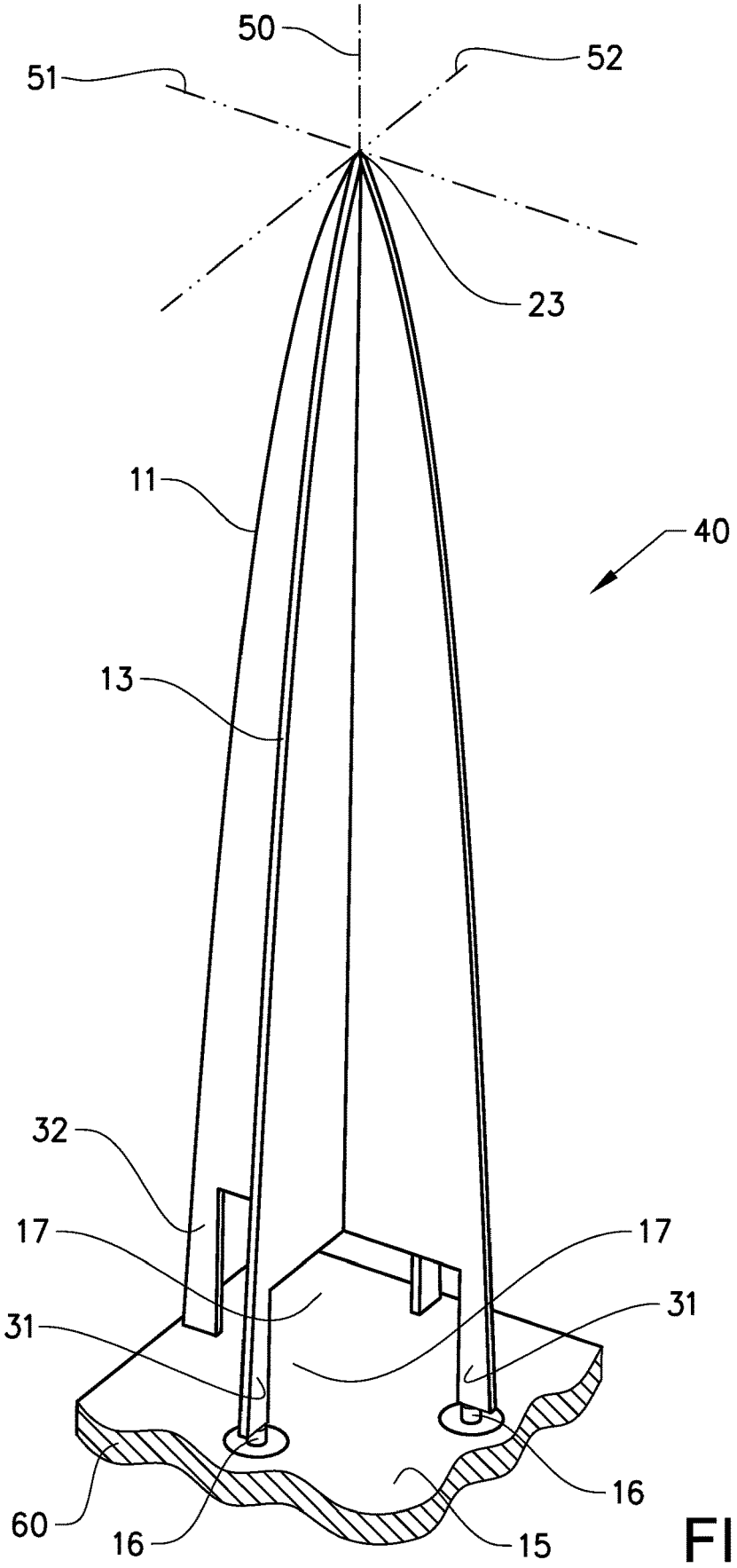
FIG. 2 shows a perspective view of a dual-polarized antenna element according to the invention.

FIG. 2 shows a perspective view of a dual-polarized antenna element 40 according to the invention. The dual-polarized antenna element 40 is formed by a first 11 and a third 13 antenna element being integral with each other, their centre axes 50 being aligned, and one being arranged in a second plane 52 perpendicular to the first plane 51. By extension of this, the antenna elements are also essentially perpendicular to each other. The dual-polarized antenna element has two feed points 16 and two cavities 17 each belonging to their respective antenna elements, also applicable for the first and second legs 31, 32.

Shown in FIGS. 1 and 2 are antenna elements 11, 12, 13, 14 which are flat with a consistent thickness throughout. However, as long as the electrical properties conferred still make it applicable to antenna use, different shapes of the elements may be used. They may not necessarily be of even thickness, and when constructing the dual-polarized antenna element 40, the two antenna elements may have a shape and size such as to when integral with each other create a cone or spike shaped dual-polarized antenna element, so long as two adjacent dual-polarized antenna elements can still function together as an antenna. Additionally, the shape of the taper of the tapered sections 21, 22 may be different. Shown are tapers of a curved shape nearing perpendicular with the ground plane as the taper approaches the feed point. However the tapers may be entirely linear, or formed in stepped sections to create the tapered sections. Additionally, the taper ends at the feed point 16 on the first leg 31 at the first tapered portion, but the taper at the second tapered portion may either end at the same height from the ground plane, or continue tapering until the ground plane 15. Furthermore, the first and second legs 31, 32 are integral with the main body 20, tip 23, and first and second tapered sections 21, 22 of each antenna element 11, 12, 13, 14.

Figure 3:
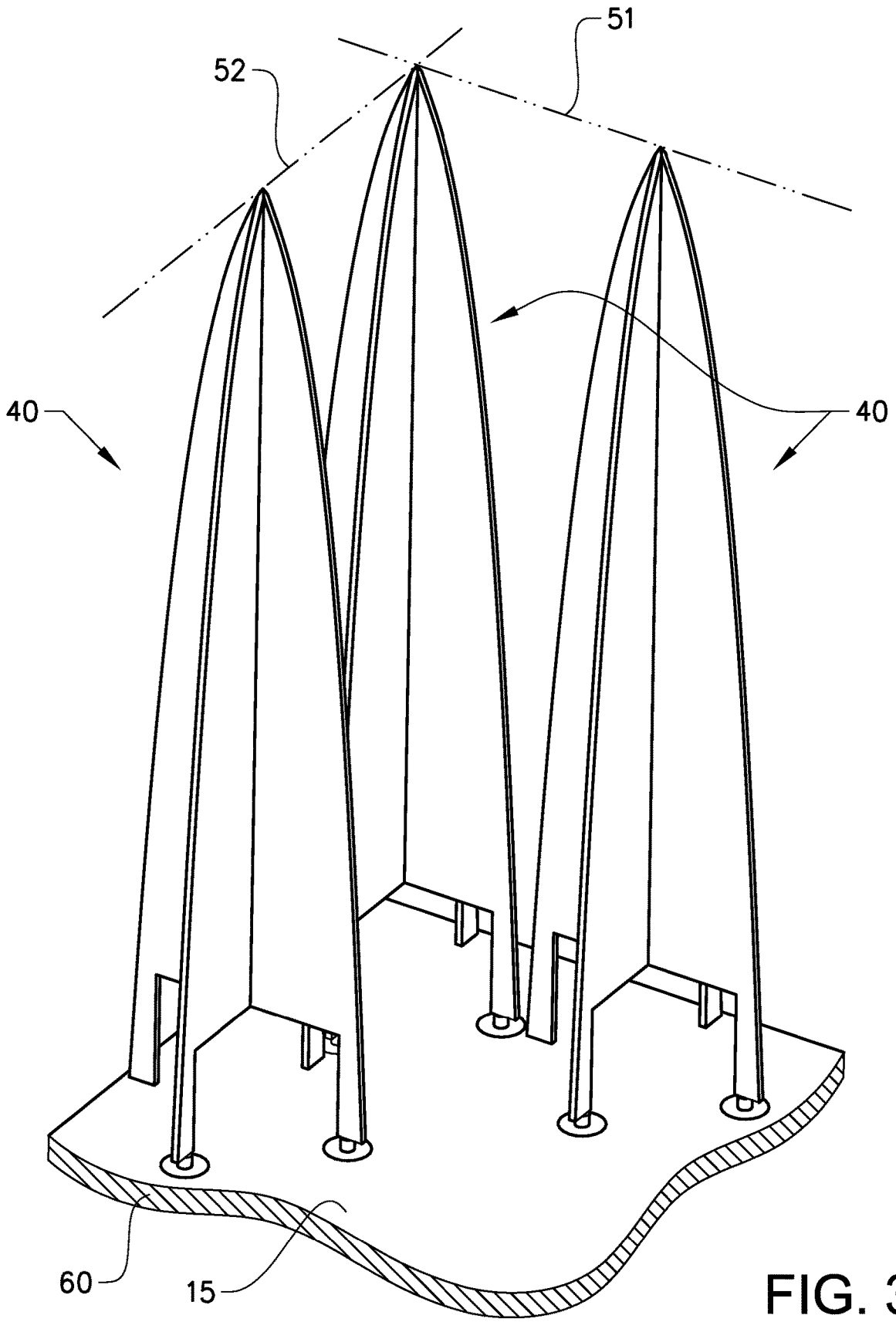
FIG. 3 shows a perspective view of a dual-polarized antenna according to the invention.

FIG. 3 shows a perspective view of a dual-polarized antenna 40 according to the invention. Shown are three dual-polarized antenna elements, each being similar in design to the one described previously and shown in FIG. 2. The antenna elements of the dual-polarized antenna elements form antennas 10 with an adjacent antenna element 11, 12, 13, 14 of a different dual-polarized antenna element located in the same plane 51, 52. The first antenna element 11 of the first dual-polarized antenna element forms a first antenna with the second antenna element 12 of the second-dual polarized antenna element. The third antenna element 13 of the first dual-polarized antenna element forms a second antenna with the fourth antenna element 14 of the third dual-polarized antenna element. The first and second antennas have different polarizations as they are arranged in the first and second planes 51, 52 respectively, where said planes are perpendicular to each other.

Figure 4:
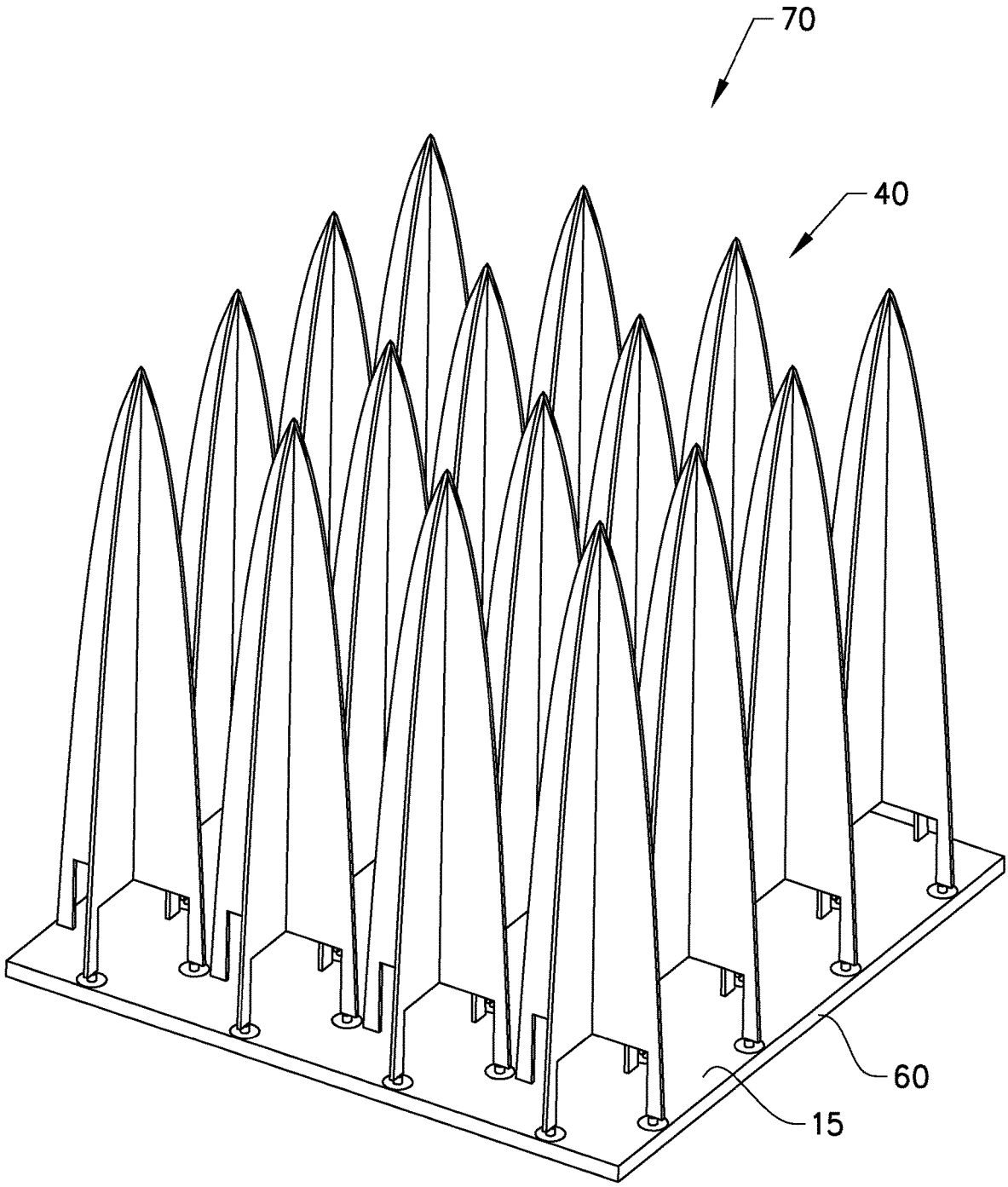
FIG. 4 shows a perspective view of an antenna array according to the invention.

FIG. 4 shows a perspective view of an antenna array 70 according to the invention. The antenna array comprises a plurality of antennas 10 with different polarization formed between antenna elements 11, 12, 13, 14 of the dual-polarized antenna elements 40. The antenna array is thus composed of dual-polarized antenna elements arranged in the first and second planes 51, 52, and in further planes parallel and/or perpendicular to these planes, i.e. arranging the dual-polarized antenna elements in a grid like manner.

The antenna array 70, or individual antennas 10 may advantageously be covered in a protective foam cover which stabilizes the antenna elements and provides protection from shock, vibrations and other mechanical stresses. Other mechanically stabilising means can also be used to increase the stability of the antenna elements such as using a dielectric material as a support structure.

The antenna array 70 is suitable for use as an Active Electronically Scanned Array (AESA) and can act as both transmitter and/or receiver and in a radar system 90. The antenna array may also be used as part of other antenna systems e.g. as part of an Electronic Warfare (EW) system 100.

REFERENCE LIST

10 Antenna
11 First antenna element
12 Second antenna element
13 Third antenna element
14 Fourth antenna element
15 Ground plane
16 Feed point
17 Cavity
18 Tapered slot
20 Main body
21 First tapered portion
22 Second tapered portion
23 Tip
31 First leg
32 Second leg
40 Dual-polarized antenna element
50 Centre axis
51 First plane
52 Second plane
60 Circuit board
61 Electrical component
62 Via hole
70 Antenna array
90 Radar system
100 Electronic warfare system

The invention claimed is:

1. An antenna comprising a ground plane and at least a first and a second antenna element, where each antenna element comprises a feed point, a cavity, a main body, a tip and at least a first tapered portion and a second tapered portion, where each antenna element is arranged on the ground plane, where said first and second tapered portions extend along the antenna element from said tip towards said ground plane of the antenna element, and where each antenna element extends essentially perpendicularly to said ground plane along a centre axis of the antenna element, where each antenna element has at least a first leg and a second leg, where said first leg extends from said main body to the first feed point, where said feed point is located between the first leg and the ground plane, and where said second leg extends from said main body to the ground plane, and where said second leg is electrically connected to the ground plane, where said main body and said first and second legs of each antenna element have a predefined thickness, where said cavity of each antenna element is formed in a space between said first and second legs, said main body and said ground plane of said antenna element, where the first and second antenna elements of the antenna are arranged in a first plane extending through the centre axes of said first and second antenna elements and adjacent each other such that a tapered slot is formed between the first tapered portion of the first antenna element and the second tapered portion of the second antenna element, and where said tapered slot tapers to said feed point, where the first tapered portion ends at the feed point on the first leg and the second tapered portion ends either at the same height from the ground plane as the first tapered portion, or at the ground plane, where the first tapered portion extends from the tip of the antenna element along a side of the element to the end of the first leg at the feed point, and where the second tapered portion extends from the tip of the antenna element along a side of the element and along the second leg.

2. An antenna according to claim 1, further comprising at least a further third and a fourth antenna element said third and fourth antenna elements corresponding to the first and second antenna elements, where the third antenna element is arranged such that the centre axis of the first antenna element is aligned with the centre axis of the third antenna element, whereby said first antenna element and said third antenna element form a dual-polarized antenna element, and where said third and fourth antenna elements are arranged in a second plane essentially perpendicular to the first plane and adjacent each other such that a tapered slot is formed between the first tapered portion of the third antenna element and the second tapered portion of the fourth antenna element.

3. Antenna according to claim 2, where said third antenna element is integral with said first antenna element to form the dual-polarized antenna element.

4. Antenna according to claim 3, where the main body of said first antenna element and said third antenna element of the dual-polarized antenna element together forms a tapered cone, and where the sum of the legs of the first antenna element and the third antenna element is at least four.

5. Antenna according to claim 1, further comprising a circuit board where one side of the circuit board constitutes the ground plane, and where the opposite side of the circuit board is equipped with at least one additional electrical component.

6. Antenna according to claim 5, where said circuit board is equipped with a via hole at the at least first feed point, where said via hole is running through said circuit board enabling an electrical connection of the feed point to an electrical component located on the opposite side of the circuit board.

7. Antenna according to claim 1, where said ground plane is equipped with a through-hole, in which a connector is arranged, where said feed point is connected to a centre conductor of said connector.

8. Antenna according to claim 1, where said antenna elements are manufactured by punching or milling a metal plate.

9. Antenna according to claim 1, where said antenna elements are manufactured by casting.

10. Antenna according to claim 1, where said antenna element is assembled to said ground plane using surface mount technology (SMT).

11. Antenna according to claim 1, where said antenna is assembled onto a printed-circuit board (PCB).

12. Antenna according to claim 1, where said antenna element is manufactured from a metallized plastic.

13. Antenna according to claim 1, where the tapered sections are formed in stepped sections.

14. Antenna according to claim 1, where the shape of said cavity is rounded.

15. Antenna according to claim 1, where the shape of said cavity is rectangular.

16. Antenna array comprising a plurality of antennas consisting of dual-polarised antenna elements according to claim 2.

17. Radar system comprising an antenna array according to claim 16.

18. Electronic warfare system comprising an antenna array according to claim 16.

* * * * *